United States Patent [19]

White

[11] Patent Number: 4,631,863

[45] Date of Patent: Dec. 30, 1986

[54] DOOR OR WINDOW GUARD SYSTEM

[76] Inventor: LeRoy L. White, 801 Delafield St., NE., Washington, D.C. 20017

[21] Appl. No.: 641,108

[22] Filed: Aug. 15, 1984

[51] Int. Cl.[4] ..... E05B 65/10

[52] U.S. Cl. ..... 49/141; 49/56

[58] Field of Search ..... 49/141, 56, 55

[56] References Cited

U.S. PATENT DOCUMENTS

| | | | |
|---|---|---|---|
| 2,668,729 | 2/1954 | Watters | 49/141 X |
| 3,843,176 | 10/1974 | Gonzalez-Cuzan . | |
| 3,921,334 | 11/1975 | Black, Sr. | 49/56 |
| 3,953,939 | 5/1976 | Klein | 49/56 |
| 4,000,590 | 1/1977 | Kordewick | 49/56 X |
| 4,019,281 | 4/1977 | Weiler | 49/56 |
| 4,055,360 | 10/1977 | Russi | 49/56 X |
| 4,057,935 | 11/1977 | Rohrberg et al. | 49/56 |
| 4,070,048 | 1/1978 | Young | 49/141 X |
| 4,162,590 | 7/1979 | Earley | 49/55 |
| 4,208,837 | 6/1980 | Black, Sr. et al. | 49/56 |
| 4,263,747 | 4/1981 | Coltrin et al. | 49/56 |
| 4,358,910 | 11/1982 | Keating et al. | 49/56 |
| 4,400,912 | 8/1983 | Wicks, Sr. | 49/56 X |

*Primary Examiner*—Philip C. Kannan

*Attorney, Agent, or Firm*—Pollock, Vande Sande & Priddy

[57] ABSTRACT

A system to prevent unauthorized entry into a room through a door or a window opening. The system includes a grille hinged on one side of the opening and bar means attached at one end to the grille and extending through a port in a wall. Means are provided to hold the bar means against an inner wall to prevent opening the grille.

8 Claims, 4 Drawing Figures

DOOR OR WINDOW GUARD SYSTEM

FIELD OF THE INVENTION

This invention relates in general to protective devices and specifically to a security system to bar unauthorized entry into a room through a door or window opening.

BACKGROUND OF THE INVENTION

Grilles which are installed at a door or a window opening to bar unauthorized entry into a room can present problems when it is necessary to use the barred area as an emergency exit, as might occur, for example, in the case of a fire within the building. In order to leave a building through an opening provided with a protective grille, it is necessary to have either means for completely removing the grille or means to swing one end of the grille away from the opening as by hinging the other end. In order to prevent someone from moving the grille or swinging it open from a position outside of the building, some devices have required the use of key-actuated locking means. It is highly desirable to avoid the use of keys because of the possibility that the key might not be available when it is necessary to exit through the window. A need exists for a security system for a window which includes a grille wherein the grille is readily and quickly openable only by a person on the inside and which may be opened without any special tools or keys.

SUMMARY OF THE INVENTION

It is accordingly one object of my invention to provide a security system capable of restricting unauthorized entry into a room through an opening in a wall.

It is another object to provide a security system having a grille hingedly mounted on the exterior side of an opening in a wall and held in a closed position by securing means operable only from the inside of said building.

It is still another object to provide a security system including a grille for covering an opening which can be opened from the inside without the use of a key or a special tool.

In accordance with my invention, I have provided a system for barring unauthorized access to a room through an opening in a wall of said room, said wall having an inner surface and an outer surface, said system comprising: a grille assembly comprising a plurality of spaced-apart bars for placement over said opening, said bars including an elongated grille bar extendible, in its closed position, past said opening and along the outer surface of said wall; hinge means connecting a side of said grille assembly to a vertical wall portion at said opening and adapted to permit the grille assembly to swing away from said opening in an outward, horizontal direction; a port in said wall spaced from said opening and aligned with an extended portion of said elongated bar when said grille is in its closed position; a horizontally extending connecting bar having inner and outer ends, said outer end of said connecting bar connected to said extended portion of said elongated bar, said connecting bar further adapted to extend through said port in said wall; and means at the inner end of said connecting bar for preventing axial movement of said connecting bar.

DETAILED DESCRIPTION

The invention will be described in more detail as it may be used with a window opening.

Figure 1:
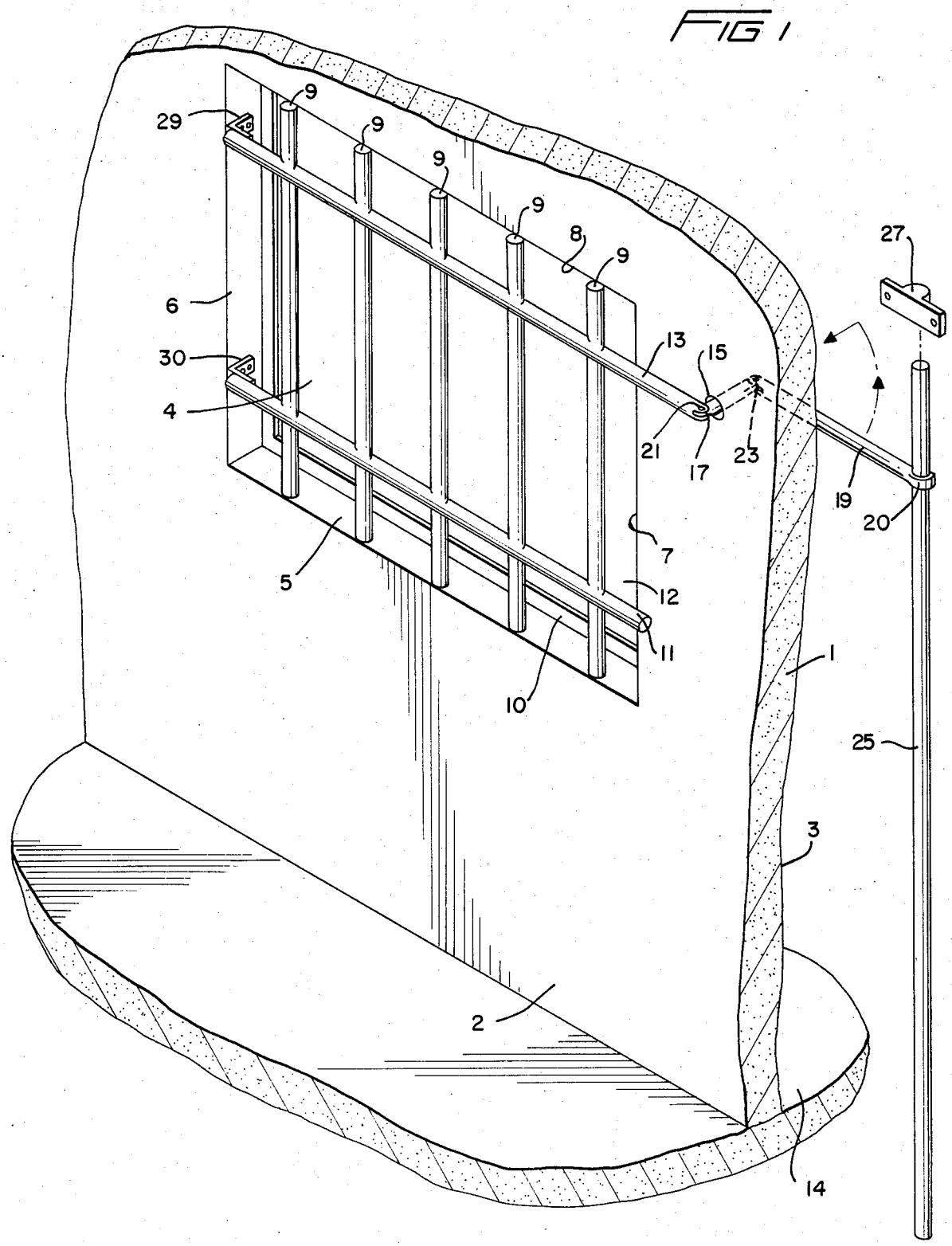
FIG. 1 is a perspective view of the invention showing the security system with the grille mounted at a window opening in a closed and secure position.

FIG. 1 shows grille 12 comprising a plurality of vertical members 9 secured together in a parallel relationship by lower horizontal member 11 and upper elongated grille bar 13 to prevent entry through window opening 4. The grille is secured to the wall 1 to block the window opening 4 by means of hinges 29 and 31 which join elongated grille bar 13 and lower bar 11, respectively, with side surface 6 of the window opening.

The grille may take a variety of forms but it must be adaptable to being hinged at one side to swing outwardly away from the window opening, and it must have at least one member which extends past the window opening on the side opposite the hinge side of the grille. The elongated bar 13 may be at the upper side of the grille, as shown, or it may be in a position such as that of bar 11, with a corresponding change in the location of port 15. The bars 9 shown as being substantially vertical, can be at angles other than the vertical, and need not be straight, and elongated grille bar 13 shown as horizontal can be at angles other than horizontal and may have a shape other than the straight shape shown. The bars can be ornamental as well as functional in design, and the term "grille" is intended to include heavy-duty screens.

The grille can be hinged to the window in a variety of ways and suitable hinge means other than that shown can be used. For example, means to permit the grille to swing open may be attached to a vertical bar positioned near the edge of the window opening. However, it is essential that the hinges be attached so that the grille swings outwardly and that the hinges cannot readily be removed from either the wall or the grille while the grille is in a closed position.

FIG. 1 shows the end of elongated grille bar 13 hinged to horizontal connecting bar 17 which passes through port 15.

The connection between grille bar 13 and connecting bar 17 can be a hinged connection as shown or the two bars may be joined so as to be immovable with respect to each other as by welding. Further, the connection between bar 13 and bar 17 need not be at the very end of bar 13, and bar 13 may extend beyond port 15. If bar 13 and bar 17 are to be joined by a hinge means as shown, it is essential that the hinge means be tamper-resistant.

Connecting bar 17 is provided with means for releasably securing its inner end at or near the inner surface 3 of wall 1. The release means may be activated at or near the port. However, if the port is close to the opening, for example, within about two feet or less of the opening, the release means should be spaced away from the port so that a person attempting a break-in will not be able to reach the release mechanism from the opening.

Figure 2:
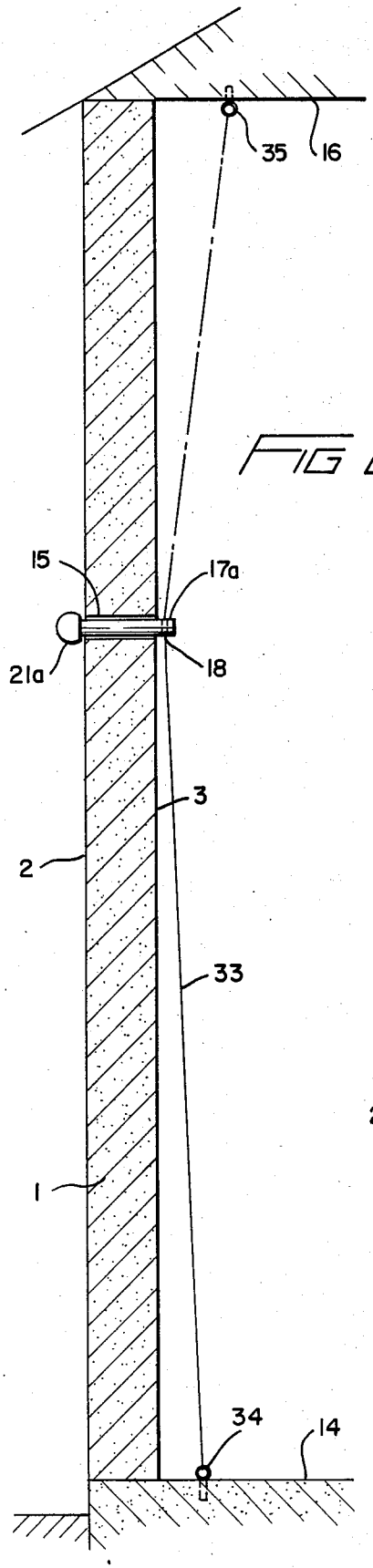
FIG. 2 is a sectional view of one example of means for retaining the grille in a closed position.

Consequently, for systems having ports relatively near the opening, it is preferred that the release means be spaced apart from the port. Such means are shown in FIG. 1 and FIG. 2.

In FIG. 1 inner end of connecting bar 17 is hinged by hinge 23 to inner wall bar 19, shown as being horizontal, which extends from bar 17 in a direction away from the window opening. Bar 17 should be just long enough to extend through the wall 1 from inner wall surface 3 to outer wall surface 2.

As shown in FIG. 1, in the secure position end 20 of bar 19 is secured against the wall by vertical bar 25 which is held in position against the wall by upper bar retaining means 27 and lower bar retaining means (not shown) in the floor 14 or mounted on wall 3. Bar 19 may be released by lifting bar 25 so that the lower end thereof clears the lower retaining means, and then moving bar 25 to one side to clear end 20 of bar 19. These steps then permit horizontal bar 19 to swing away from inner surface 3 of wall 1 until it is in a straight line with bar 17. When bar 19 is lined up with bar 17, the grille can be pushed so that it swings outwardly on hinges 29 and 31.

It is obvious that bar 19 could be retained in place by a variety of retaining means, the only requirement being that it can be operable only by a person standing on the inside of the room. The arrangement of bar 17 hinged to bar 19 is such that it takes very little force acting against end 20 to prevent outward movement of bar 17.

The bar 19 is shown as horizontal, and that is its preferred orientation. However, the invention contemplates hinging bar 17 to bar 19 in such a way that bar 19 is at an angle from the horizontal, or hinging bar 17 at either or both inner and outer ends by a universal joint. The use of a universal joint would permit bar 19 to be oriented so as to assume a wide range of angles from the horizontal and thus be adjustable in placing the means to retain bar 19 parallel to the wall.

Figure 3:
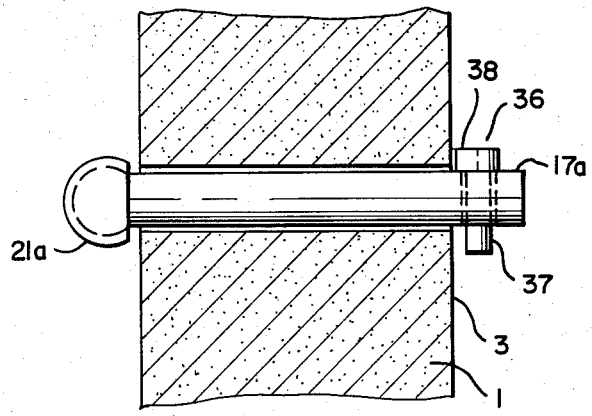
FIG. 3 is a sectional view of an alternative means for retaining the grille in a closed position.
Figure 4:
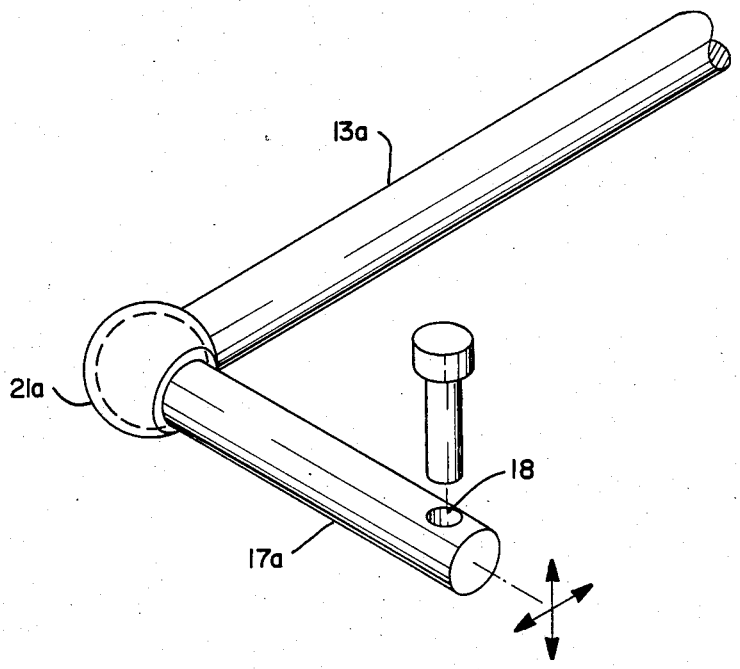
FIG. 4 is a perspective view of a portion of the security system showing additional details.

FIGS. 2, 3, and 4 show examples of modifications of means for securing the inner end of connecting bar 17*a* near the inner surface 3 of wall 1. These figures show universal joint 21*a* connecting bar 17*a* with bar 13*a*.

FIG. 2 illustrates another means for securing the grille in place under circumstances where port 15 is relatively close to an edge 7 of the window opening 4. Bar 17*a* is provided near its end thereof with aperture 18 through which cable 33 is passed. One end of cable 33 is attached by means 35 near ceiling 16. The other end of cable 33 is releasably attached by means 34, such as a hook and eye arrangement. In an arrangement using a cable, such as is shown in FIG. 2, one or both ends of the cable may, alternatively be secured to wall 3.

FIGS. 3 and 4 illustrate means which may be used to secure the inner end of connecting bar 17*a* near wall 3 when the port 15 is far enough away from the window opening. In the embodiment shown in these figures, pin 36 having shank 37 and head 38 fits within aperture 18. When in place, pin 36 blocks withdrawal of bar 17*a* from wall 3.

As a modification to the embodiment of FIGS. 3 and 4, the aperture 18 in rod 17*a* need not extend through rod 17*a*, but may be a blind hole. A pin not having a head as does pin 36 may then be used as a retaining means.

I claim:

1. A system for barring unauthorized access to a room through an opening in a wall of said room, said wall having an inner surface and an outer surface, said system comprising:

a grille assembly comprising a plurality of spaced-apart bars for placement over said opening, said bars including an elongated grille bar extendible past said window opening and along the outer surface of said wall;

hinge means connecting a side of said grille assembly to a vertical wall portion at said opening and adapted to permit the grille assembly to swing away from said opening in an outward, horizontal direction;

a port in said wall spaced from said opening and aligned with an extended portion of said elongated bar;

a horizontally extending connecting bar having inner and outer ends, said outer end connected to an extended portion of said elongated grille bar and said connecting bar adapted to extend through said port in said wall; and an inner wall bar having first and second ends; means hingedly connecting said first end of said inner wall bar with said inner end of said connecting bar; and bar means cooperating with said second end of said inner bar for urging said inner wall bar against said inner surface and releasably securing said inner wall bar substantially parallel and in close proximity to the inner surface of said wall.

2. A system according to claim 1 wherein said elongated grille bar is a horizontal bar.

3. A system according to claim 1 wherein said horizontally extending connecting bar is hingedly connected to an end of said elongated grille bar.

4. A system according to claim 1 wherein said inner wall bar is a horizontal bar.

5. A system according to claim 1 wherein said elongated grille bar and said inner wall bar are each horizontal bars.

6. A system according to claim 1 wherein at least one of the ends of said connecting bar comprises a universal joint.

7. A system according to claim 1 wherein said grille assembly comprises a plurality of vertical bars secured to and held in spaced-apart relationship by at least two horizontal bars.

8. A system according to claim 7 wherein one of said horizontal bars is elongated and is hingedly connected at one end to the outer end of said horizontally extending connecting bar.

* * * * *